United States Patent [19]

Nakamura

[11] Patent Number: 4,854,370

[45] Date of Patent: Aug. 8, 1989

DIE CASTING APPARATUS

[24] Inventory: Hiromi Nakamura, Zama, Japan

[75] Assignee: Toshiba Kikai Kabushiki Kaisha, Tokyo, Japan

[21] Appl. No.: 239,691

[22] Filed: Sep. 2, 1988

Related U.S. Application Data

[63] Continuation-in-part of Ser. No. 4,646, Jan. 20, 1987, abandoned.

[30] Foreign Application Priority Data

Jan. 20, 1986 [JP] Japan ..... 61-10676

[51] Int. Cl.[4] ..... B22D 27/00

[52] U.S. Cl. ..... 164/259; 164/312

[58] Field of Search ..... 164/259, 66.1, 113, 164/312

[56] References Cited

U.S. PATENT DOCUMENTS

| | | | |
|---|---|---|---|
| 3,400,752 | 9/1968 | Unsworth | 164/66.1 |
| 4,240,497 | 12/1980 | Glazunov et al. | 164/312 |
| 4,583,579 | 4/1986 | Miki et al. | 164/113 |

FOREIGN PATENT DOCUMENTS

| | | | |
|---|---|---|---|
| 1442853 | 5/1966 | France | 164/312 |
| 41-10612 | 6/1966 | Japan . | |
| 57-97860 | 6/1982 | Japan | 164/66.1 |
| 59-6055 | 1/1984 | Japan . | |
| 2129343 | 5/1984 | United Kingdom | 164/113 |

*Primary Examiner*—Kuang Y. Lin

*Attorney, Agent, or Firm*—Birch, Stewart, Kolasch & Birch

[57] ABSTRACT

A die casting apparatus has a sleeve having one end communicating with a die cavity defined by a movable die and a fixed die and connected to a feed pipe, a plunger slidably fitted in the sleeve for forcing molten metal supplied from the feed pipe through the sleeve into the die cavity, and a hydraulic cylinder for moving the plunger in the sleeve. An inert gas supply unit communicates with the sleeve for supplying an inert gas to a passage defined in the sleeve and also to the feed pipe. The inert gas supply unit comprises a closed casing and a gas feed pipe for supplying the inert gas into the closed casing. The casing is connected to an opposite end of the sleeve in covering relation thereto, and has a window for visually checking the interior of the casing therethrough.

7 Claims, 3 Drawing Sheets

DIE CASTING APPARATUS

This application is a continuation-in-part of Ser. No. 004,646, filed Jan. 1, 1987, abandoned.

BACKGROUND OF THE INVENTION

The present invention relates to a die casting apparatus, and more particularly to a die casting apparatus for producing a die casting by supplying molten metal into a die cavity defined by a movable die and a fixed die, the die casting apparatus preventing the molten metal from being oxidized while it is ,being forced into the die cavity, being capable of easily recovering small metal pieces attached to a plunger which forces the molten metal, and also preventing the molten metal from being scattered, so that the produced die casting will be of good quality and no unexpected accidents will occur during the production of the die casting.

As disclosed in Japanese Laid-Open Utility Model Publication No. 59-6055 and Japanese Laid-Open Patent Publication No. 41-10612, conventional die casting apparatus have a feed pipe for feeding molten metal to the die cavity. The feed pipe is connected between the die cavity and a heating furnace which contains molten metal at a desired temperature. By forcing the molten metal under pressure into the feed pipe, the molten metal is forcibly fed into the die cavity, in which the molten metal is forcibly or naturally cooled to produce a die casting.

The feed pipe has its inner wall communicating directly or indirectly with ambient air, so that the ambient air can always flow into and out of the feed pipe. A thin film of molten metal which may be attached to the inner wall of the feed pipe is therefore exposed to ambient air, and combined with oxygen contained in the ambient air thereby forming an oxide, which tends to be deposited on the inner wall of the feed pipe. The oxide deposit on the feed pipe may grow to the extent which clogs or unduly limits the passage in the feed pipe, with the result that molten metal cannot smoothly flow through the feed pipe.

The deposited oxide may come off the inner wall and flow into the die cavity, whereupon a die casting with the oxide mixed therein will be produced. The die casting thus produced is of poor quality and has an insufficient degree of mechanical strength required for a final product. The die casting containing such oxide also lacks a desired degree of uniform density.

Some molten metal is liable to be forced out through a small gap between the outer peripheral portion of the tip end of a plunger which forces the molten metal into the die cavity, and the injection sleeve. The molten metal which has thus been forced out turns into small metal pieces which may contaminate surrounding areas or break other nearby machines and apparatus.

SUMMARY OF THE INVENTION

It is a principal object of the present invention to provide a die casting apparatus having means for preventing an oxide from being formed in a feed pipe communicating between a die cavity and a heating furnace which holds molten metal, thereby allowing the die casting apparatus to be operated without failure and to be serviced and maintained easily, and also to produce die castings of desired density and high mechanical strength.

Another object of the present invention is to provide a die casting apparatus having inert gas supplying means associated with a plunger which forces molten metal into a die cavity, for supplying an inert gas to prevent an oxide film from being produced on the molten metal, so that a die casting of good product quality can be produced.

Still another object of the present invention is to provide a die casting apparatus having molten metal forcing means including inert gas supplying means, the molten metal forcing means having an inspection window for confirming operating conditions and the like of the molten metal forcing means, and also for observing the manner in which small metal pieces are deposited, so that the die casting apparatus can easily be serviced and maintained.

Yet another object of the present invention is to provide a die casting apparatus comprising: a sleeve having one end communicating with a die cavity defined by a movable die and a fixed die and connected to a feed pipe; a plunger slidably fitted in said sleeve for forcing molten metal supplied from said feed pipe through said sleeve into said die cavity; driver means for moving said plunger in said sleeve; and supply means communicating with said sleeve for supplying an inert gas to a passage defined in said sleeve and also to said feed pipe, said supply means comprising a closed casing and a gas feed pipe for supplying the inert gas into said closed casing, said casing being connected to an opposite end of said sleeve in covering relation thereto, said casing having a window for visually checking the interior of the casing therethrough.

The above and other objects, features and advantages of the present invention will become more apparent from the following description when taken in conjunction with the accompanying drawings in which a preferred embodiment of the present invention is shown by way of illustrative example.

The present invention will become more fully understood from the detailed description given hereinbelow and the accompanying drawings which ar given by way of illustration only, and thus, are not limitative of the present invention, and wherein:

DETAILED DESCRIPTION OF THE PREFERRED EMBODIMENT

Figure 1:
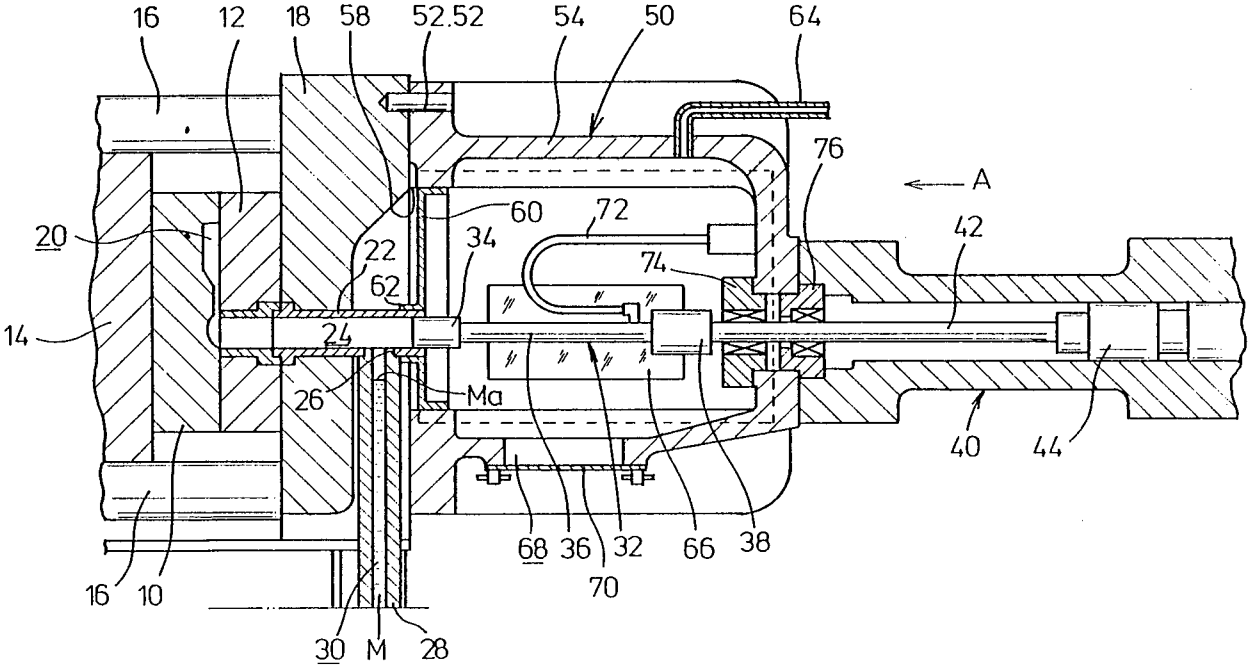
FIG. 1 is a fragmentary vertical cross-sectional view of a die casting apparatus according to the present invention, the view showing one condition of operation of the die casting apparatus.
Figure 2:
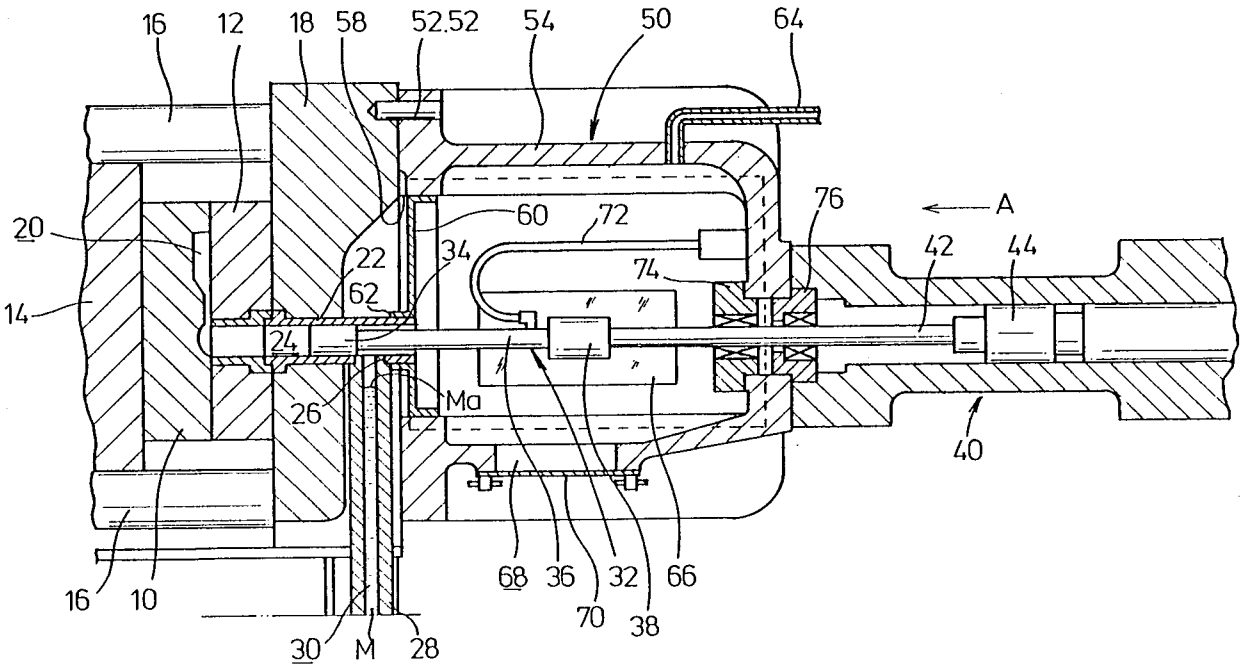
FIG. 2 is a fragmentary vertical cross-sectional view showing another condition of operation of the die casting apparatus.

As shown in FIGS. 1 and 2, a die casting apparatus according to the present invention includes a movable die 10 and a fixed die 12. The movable die 10 is supported on a first support member 14 for movement toward and away from the fixed die 12 through tie bars 16. The fixed die 12 is supported on a second support member 18. The movable and fixed dies 10, 12 define a die cavity 20 therebetween. The fixed die 12 and the second support member 18 jointly hold a sleeve 22 fitted in holes defined respectively in the fixed die 12 and the second support member 18. The sleeve 22 has a tip end communicating with the die cavity 20 through a runner. The sleeve 22 defines therein a passage 24 and has a hole 26 defined in a bottom wall thereof. A feed pipe 28 is connected at one end to the sleeve 22 through the hole 26. The feed pipe 24 has an inner passage 30 communicating with the passage 24 in the sleeve 22 through the hole 26. The other end of the feed pipe 28 is connected to the heating furnace of a molten metal feeder (not shown), so that molten metal will be supplied from the heating furnace through the inner passage 30 and the passage 24 into the die cavity 20.

A plunger 32 includes a plunger head 34 displaceably inserted in the sleeve 2 through the other end thereof. The plunger head 34 is supported on a plunger rod 36 coupled by a connector 38 to a piston rod 42 connected to a piston 44 slidably fitted in a hydraulic cylinder 40. Therefore, the piston rod 42 is axially movable by a hydraulic fluid introduced under pressure into the hydraulic cylinder 40. When the piston 44 is moved in the direction of the arrow A, the plunger head 34 is displaced into the sleeve 22 in the direction of the arrow A by the plunger rod 36.

Figure 3:
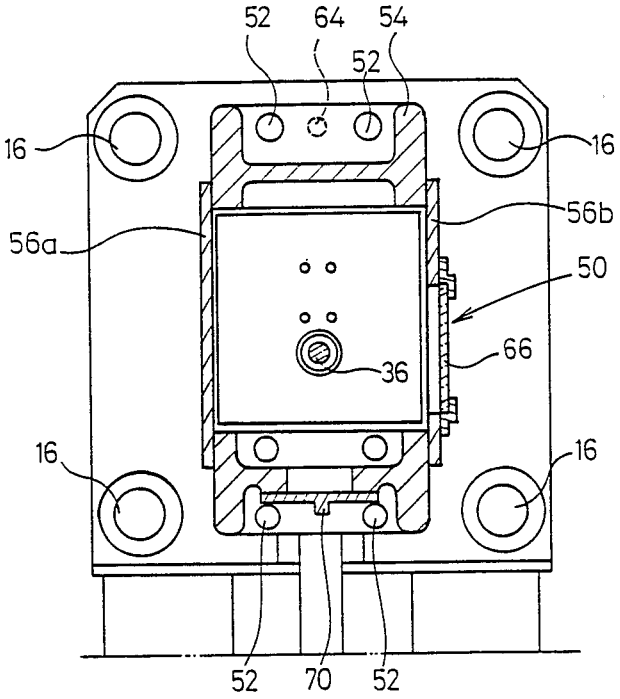
FIG. 3 is a side elevational view of the die casting apparatus.

A closed casing or box 50 is interposed between the sleeve 22 and the hydraulic cylinder 40. The closed casing 50 basically comprises a C-shaped frame 54 fixed to the second support member 18 by means of a plurality of bolts 52, and casing covers **56*a*, 56*b* (FIG. 3) closing the opposite openings of the C-shaped frame 54. A partition 60 is fitted in an opening 58 of the C shaped frame 54 near the second support member 18, and has a circular hole defined therein by an annular tube 62 projecting from the partition 60 toward the fixed die 12 and fitted over the end of the sleeve 22. A gas feed pipe 64 is connected to an upper portion of the C-shaped frame 54 for feeding an inert gas into the closing casing 50. A window 66 constructed of a sheet of reinforced transparent glass or the like for allowing the operator to visually check the interior of the closed casing 50 is openably and closably attached to the casing cover 56*b* through a seal member (not shown). The plunger rod 36 and other various components (not shown) housed in the closed casing 50 can be serviced and maintained by opening the window 66. The C-shaped frame 54 has a slightly slanted bottom having an opening 68 defined therein which is openably closed by a cover member 70. Small metal pieces which are forced out through the gap between the sleeve 22 and the plunger head 34 and deposited in the casing 50 can be removed by opening the cover member 70. The plunger rod 36 has an axial bore (not shown) defined longitudinally therein for circulating cooling water therethrough. The bore has ends closer to the connector 38 which are joined to two parallel flexible tubes 72 such as rubber hoses that introduce cooling water into the bore and discharge cooling water from the bore. Sealing members 74, 76 are disposed between the closed casing 50 and the piston rod 40 of the hydraulic cylinder 40 for preventing an inert gas filled in the closed casing 50 from leaking out of the closed casing 50**.

Operation and advantages of the die casting apparatus thus constructed will be described below.

During an initial stage of a die casting process, the plunger head 34 is in the position shown in FIG. 1. That is, the plunger head 34 is partly positioned in the sleeve 22 but retracted rightwardly of the hole 26 which serves as a sprue. In this position, the die cavity 20, the passage 24 of the sleeve 22, and the inner passage 30 of the feed pipe 26 are in mutual communication. The closed casing 50 is supplied with an inert gas from the gas feed pipe 64. The inert gas used is preferably sulfur hexafluoride gas ($SF_6$), argon gas (Ar), carbon dioxide gas ($CO_2$), nitrogen gas ($N_2$), or the like, which is supplied into the closed casing 50 under approximately $10^{-3}$ bar, for example. Specifically, where molten metal M fed from the feed pipe 26 is a highly active magnesium based alloy, sulfur hexafluoride gas ($SF_6$) or argon gas (Ar) that is employed in a dissolving surface is used as the inert gas. Where molten metal M is an aluminum-based alloy or a zinc-based alloy, carbon dioxide gas ($CO_2$) or nitrogen gas ($N_2$) is selected as the inert gas under various conditions.

The inert gas in the closed casing 50 is less liable to leak into the passage 24 since the plunger head 34 is partly fitted hermetically in the passage 24.

When a switch (not shown) associated with the metal feeder is turned on under this initial condition, the molten metal feeder is operated to supply the molten metal M from the heating furnace through the feed pipe 28 and the hole 26 into the passage 24 of the sleeve 22. As the molten metal M thus supplied reaches a prescribed amount in the passage 24, the hydraulic cylinder 40 is actuated. The plunger rod 36 is displaced in the direction of the arrow A through the piston rod 42 and the connector 38, and so is the plunger head 34 to force the molten metal M from the sleeve 22 via the runner (not shown) into the die cavity 20. During this time, the plunger head 34 itself is heated to a very high temperature since its front end face is in contact with the molten metal M which is kept at a very high temperature. However, the plunger head 32 is cooled for protection against thermal expansion because cooling water is supplied via the rubber hoses 72 into the non-illustrated bore of the plunger rod 36. Accordingly, the plunger head 34 is kept at a suitable temperature while it is slidingly moving in the sleeve 22. The molten metal M supplied to the die cavity 20 is solidified in a cooling process into a die casting.

When the plunger head 34 starts advancing in the direction of the arrow A, the operation of the molten metal feeder is stopped, and an upper surface Ma of the molten metal M is maintained slightly below the hole 26 as shown in FIG. 1, providing a space in the feed pipe 28 between the hole 26 and the upper surface Ma of the molten metal M. As the plunger head 34 is moved into the sleeve 22 past the hole 26, the inert gas filled in the closed casing 50 flows through a gap defined between the plunger rod 36 of the plunger 32 and the inner wall surface of the sleeve 22 into the space in the feed pipe 28. A thin film of the molten metal M which is deposited on the inner wall surface of the feed pipe 28 and the upper surface Ma of the molten metal M are fully covered with the inert gas thus introduced into the feed pipe 22, and hence are prevented against exposure to ambient air. Thus, the molten metal is protected from oxidation.

The window 66 of reinforced transparent glass allows the operator to visually observe the interior of the closed casing 50 so that suitable action can immediately be taken when it is found that the plunger 32 should be replaced, or for confirming whether small metal pieces or particles are present which may have been formed by a small amount of the molten metal M that has leaked over the outer periphery of the plunger head 34 during forced introduction of the molten metal M into the die cavity 20 by the plunger 32. The plunger 32 can easily be replaced by opening the window 66.

When it is confirmed through the window 66 that a large quantity of small metal particles are present in the closed casing 50, they can easily be removed by opening the cover member 70. Since the bottom of the closed casing 50 is slightly slanted, small meal pieces which have been brought by the plunger head 34 are guided by the slanted bottom surface of the closed casing 50 toward the hole 68 and placed on the cover member 70. Therefore, such small metal pieces can easily be removed by opening the cover member 70.

In case the die casting apparatus is left for a long period of time with the upper surface Ma of the molten metal M communicating with the die cavity 20 as shown in FIG. 1, the upper surface Ma is rapidly oxidized, forming an oxide. In order to prevent this, the plunger head 34 is advanced beforehand into the sleeve 22 to the position illustrated in FIG. 2 to keep the inner passage 30 of the feed pipe 30 in communication with the interior of the closed casing 50. The inert gas supplied from the closed casing 50 fills the feed pipe 28 to prevent the molten metal M in the inner passage 30 from being oxidized. Immediately before the molten metal M is supplied into the sleeve 22, the plunger head 34 is retracted toward the hydraulic cylinder 40 as shown in FIG. 1, and then the same process as described above is performed.

During use of the die casing apparatus over a long interval of time, the outer periphery of the plunger head 34 wears due to sliding movement against the inner wall surface of the sleeve 20. If the plunger head 34 wears excessively, then the molten metal M tends to be forced out of the sleeve 22 through the small clearance between the sleeve 2 and the plunger head 34 when the plunger head 34 is displaced into the sleeve 22 by the hydraulic cylinder 40. However, the molten metal M is prevented from being scattered out of the die casting apparatus since the end of the sleeve 22 is thoroughly closed by the closed casing 50, and hence the molten metal M would not be turned in contact with oxygen contained in ambient air. Accordingly, the die casting apparatus of the present invention is safe and ease to handle during operation.

With the arrangement of the present invention, the deposits of the molten metal on the inner wall surface of the feed pipe and the upper surface of the molten metal in the feed pipe are covered with the inert gas, and hence the feed pipe will not be clogged with an oxide of the molten metal, thus preventing unexpected accidents which would otherwise result from the clogging of the feed pipe. A die casting produced by the die casting apparatus does not contain oxides therein, and therefore is high in mechanical strength and density.

Furthermore, the window is provided for allowing the operator to visually inspect the interior of the closed casing for facilitating the servicing and maintenance of the die casting apparatus. The closed casing is constructed of the C-shaped frame and the casing covers detachably attached to the C-shaped frame on its opposite sides. The plunger rod and other components in the closed casing can be replaced by detaching the casing covers.

In addition, the bottom of the closed casing has the opening through which small metal pieces that are formed by solidification of molten metal can easily be removed.

A seal member may be interposed between the closed casing 50 and the end of the sleeve 22.

Although a certain preferred embodiment has been shown and described, it should be understood that many changes and modifications may be made therein without departing from the scope of the appended claims.

What is claimed is:

1. A die casting apparatus comprising:

a sleeve having one end communicating with a die cavity defined by a movable die and a fixed die and connected to a feed pipe;

a plunger slidably fitted in said sleeve for forcing molten metal supplied from said feed pipe through said sleeve into said die cavity;

driver means for moving said plunger in said sleeve;

supply means communicating with said sleeve for supplying an inert gas to a passage defined in said sleeve and also to said feed pipe, said supply means comprising a closed casing and a gas feed pipe for supplying the inert gas into said closed casing, said casing being connected to an opposite end of said sleeve in covering relation thereto, said casing having a window for visually checking the interior of the casing therethrough; said casing has an opening defined in a bottom thereof for removing small metal pieces from said casing.

2. A die casting apparatus according to claim 1, wherein said bottom of the casing has an inner surface slanted at a prescribed angle toward said opening.

3. A die casting apparatus according to claim 1 or 2, further comprising a cover member openably and closably attached over said opening defined in the bottom of said casing.

4. A die casting apparatus according to claim 1, wherein said plunger has a plunger head with an end facing into said casing, said casing and said sleeve and said feed pipe communicating with each other through a passage defined upon movement of said plunger head into said sleeve, for thereby introducing the inert gas from within said casing said sleeve and said feed pipe.

5. A die casting apparatus according to claim 4, further comprising a plunger rod supporting said plunger head disposed in said casing, said plunger rod having a passageway for delivering cooling water to cool said plunger head.

6. A die casting apparatus according to claim 5, further cinorusubg a flexible tube for supplying the cooling water said passageway.

7. A die casting apparatus according to claim 5, wherein said driver means comprises a cylinder mounted on said casing and including a piston rod connected to said plunger rod through a connector, further comprising a seal member disposed between said casing and said cylinder.

* * * * *